US006410097B2

(12) United States Patent
Kume et al.

(10) Patent No.: US 6,410,097 B2
(45) Date of Patent: Jun. 25, 2002

(54) PROCESS FOR PRODUCING PRINTING SHEET

(75) Inventors: Katsuya Kume; Katsuyuki Okazaki, both of Osaka (JP)

(73) Assignee: Nitto Denko Corporation, Osaka (JP)

( * ) Notice: Subject to any disclaimer, the term of this patent is extended or adjusted under 35 U.S.C. 154(b) by 0 days.

(21) Appl. No.: 09/756,790

(22) Filed: Jan. 10, 2001

(30) Foreign Application Priority Data

Jan. 17, 2000 (JP) ..... 2000-007954

(51) Int. Cl.[7] ..... B05D 3/02

(52) U.S. Cl. ..... 427/387; 427/393.5; 162/135; 162/136

(58) Field of Search ..... 427/393.5, 387; 162/135, 136

(56) References Cited

U.S. PATENT DOCUMENTS 5,578,365 A 11/1996 Kume et al. ..... 428/195

6,280,827 B1 * 8/2001 Kume et al. ..... 428/195

FOREIGN PATENT DOCUMENTS

CA 1240515 * 8/1988

* cited by examiner

*Primary Examiner*—Erma Cameron

(74) *Attorney, Agent, or Firm*—Sughrue Mion, PLLC

(57) ABSTRACT

A process which is for efficiently producing a silicone-based printing sheet and capable of forming an ink-receiving layer which is excellent in the fixability of a thermal transfer ink thereto and can be peeled off easily. The process comprises spreading a coating liquid containing at least a cellulosic polymer and a silicone resin as components on a carrier film wherein at least a surface layer on the side to be coated with the coating liquid is made of poly(vinylidene fluoride), and drying the coating to form an ink-receiving layer.

2 Claims, No Drawings

PROCESS FOR PRODUCING PRINTING SHEET

FIELD OF THE INVENTION

The present invention relates to a process for efficiently producing a silicone-based printing sheet which has an excellent ability to fix a thermal transfer ink thereto and is suitable for use in forming management labels or the like therefrom.

BACKGROUND OF THE INVENTION

The present inventors previously proposed a process for producing a printing sheet by spreading a coating liquid containing a cellulosic polymer and a silicone resin as components on a carrier film comprising a poly(ethylene terephthalate) (PET) film and drying the coating to obtain an ink-receiving layer (JP-A-2000-98902 and JP-A-2000-212304). This printing sheet is intended to be used in such a manner that the ink-receiving layer is peeled from the PET film and ink information is imparted to the thus-exposed surface of the layer by thermal transfer printing to thereby obtain a printed sheet such as a management label. The use of a PET film makes this application possible.

Namely, due to the use of a PET film, the cellulosic polymer segregates and comes to be present in a higher concentration on the PET film side to thereby form an ink-receiving layer having the excellent ability to fix inks thereto. If a carrier film made of a non-polar polymer such as a silicone or olefin polymer is used, the component which segregates and comes to be present in a higher concentration on the carrier film side is the silicone resin, resulting in an ink-receiving layer to which inks are less apt to be fixed and clear ink information is difficult to impart. In the case of using a PET film, however, the ink-receiving layer formed should be peeled off at a high speed in an atmosphere having a temperature as low as about −30° C. partly because of the segregation of the cellulosic polymer. The conventional technique described above hence has a drawback that the production efficiency is low.

SUMMARY OF THE INVENTION

An object of the invention is to provide a process which is for efficiently producing a silicone-based printing sheet and capable of forming an ink-receiving layer which is excellent in the fixability of a thermal transfer ink thereto and can be peeled off easily.

The invention provides a process for producing a printing sheet which comprises spreading a coating liquid containing at least a cellulosic polymer and a silicone resin as components on a carrier film wherein at least a surface layer on the side to be coated with the coating liquid is made of poly (vinylidene fluoride), and drying the coating to form an ink-receiving layer.

According to the invention, by forming an ink-receiving layer on a poly(vinylidene fluoride) surface, not only a cellulosic polymer can be segregated and caused to be present in a higher concentration on the carrier film side to thereby enable the ink-receiving layer to be excellent in the fixability of a thermal transfer ink thereto, but also this ink-receiving layer is not strongly adhered to the poly (vinylidene fluoride) surface and can hence be easily peeled off even at ordinary temperature according to the carrier film comprising the non-polar polymer. Consequently, a printing sheet can be efficiently obtained from which a variety of printed sheets having excellent flexibility can be formed according to circumstances by imparting ink information thereto by an appropriate printing technique, e.g., thermal transfer printing.

The process of the invention comprises spreading a coating liquid containing at least a cellulosic polymer and a silicone resin as components on a carrier film wherein at least a surface layer on the side to be coated with the coating liquid is made of poly(vinylidene fluoride), and drying the coating to form an ink-receiving layer and thereby obtain a printing sheet.

DETAILED DESCRIPTION OF THE INVENTION

The present invention is described in detail below.

The carrier film is a member for forming an ink-receiving layer thereon, and the film itself does not serve as a component of the printing sheet to be produced. The carrier film for use in the invention is one in which at least a surface layer is made of poly(vinylidene fluoride). Consequently, the carrier film may be one wholly made of poly(vinylidene fluoride), or may be one comprising a supporting substrate made of an appropriate material, such as PET, a polyolefin, paper or a metal foil, and a coating film of poly(vinylidene fluoride) formed on a surface of the substrate.

For forming an ink-receiving layer on the carrier film by coating, a coating liquid is used which contains at least a cellulosic polymer and a silicone resin as components. The cellulosic polymer is used for the purposes of improving ink fixability in thermal transfer printing, enhancing the strength of the printing sheet, etc. One or more suitable cellulosic polymers such as ethyl cellulose can be used.

On the other hand, the silicone resin is used as a substrate for the printing sheet. The silicone resin that can be used is one or more suitable polysiloxanes having structural units represented by, for example, the formula $R_xSiO_y$ (wherein R represents an organic group, e.g., an aliphatic hydrocarbon group such as methyl, ethyl, or propyl, an aromatic hydrocarbon group such as phenyl, or an olefin group such as vinyl, a hydrolyzable group such as an alkoxy, or a hydroxyl group; x is 0 to 3; and y is 4 or smaller).

Examples of the silicone resin further include alkyd-modified polysiloxanes, phenol-modified silicone resins, melamine-modified polysiloxanes, epoxy-modified polysiloxanes, polyester-modified polysiloxanes, acrylic-modified polysiloxanes, urethane-modified polysiloxanes, silicones modified with a higher fatty acid ester, higher-alkoxy-modified silicones, and polyether-modified silicones. Such modified silicones may be used alone or in combination of two or more thereof.

From the standpoint of obtaining, for example, Braun tube management labels which withstand even the salvage step in which Braun tubes are treated with hot nitric acid, it is preferred to use as the silicone resin an appropriate MQ resin which is known as, e.g., a tackifier for silicone-based pressure-sensitive adhesives and comprises a polymer comprising monofunctional units M represented by the general formula $R_3SiO$—and quadrifunctional units Q represented by the formula Si (O—)$_4$. In the general formula, R is the same as defined above.

Printed sheets obtained by imparting ink information to the printing sheet employing the MQ resin can be satisfactorily adhered to, e.g., adherends having curved surfaces. Through a heat treatment, the printed sheets applied can be easily bonded tightly to the adherends to thereby form burned sheets satisfactorily retaining the imparted information. The burned sheets thus formed are excellent in chemical resistance, heat resistance, weatherability, and other properties because the silica yielded from the MQ resin or silicone resin by the burning has been sintered. The burned sheets can be effectively utilized as management labels or the like, for example, from the production of Braun tubes to the salvage thereof.

The printing sheet can be produced in, for example, the following manner. Ingredients including a cellulosic polymer and a silicone resin are mixed together by means of a ball mill or the like using an organic solvent or the like according to need to prepare a coating liquid. This coating liquid is spread on the poly(vinylidene fluoride) side of a carrier film by an appropriate technique, e.g., doctor blade method or gravure roll coater method, and then dried. The resulting dry coating film serving as an ink-receiving layer is peeled from the carrier film to form the target sheet.

In preparing the coating liquid, various ingredients can be incorporated thereinto for the purposes of coloration of the ink-receiving layer to be obtained and of improving the heat resistance, flexibility, and chemical resistance of the ink-receiving layer, ink fixability thereto, etc. Examples of such optional ingredients include inorganic particles and organic compounds such as silicone rubbers, hydrocarbon polymers, vinyl or styrene polymers, acetal polymers, butyral polymers, acrylic polymers, polyester polymers, urethane polymers, cellulose polymers, and various waxes.

The incorporation of inorganic particles is intended mainly to impart heat resistance so that the printing sheet can withstand temperatures of from 500 to 800° C. and to color the printing sheet or printed sheet for forming a background color. One or more kinds of suitable inorganic particles can hence be used, such as metal particles or ceramic particles. Although the particle diameter of the inorganic particles is generally 50 $\mu$m or smaller, preferably from 0.05 to 20 $\mu$m, it is not limited thereto. To incorporate a flaky powder prepared by adhering inorganic particles to thin platy bases such as mica is effective in improving hiding power or reflectance.

Examples of inorganic particles generally used include white particles such as particles of silica, titania, alumina, zinc white, zirconia, calcium oxide, mica, potassium titanate, and aluminum borate. Examples thereof further include metal compounds, such as carbonates, nitrates, and sulfates, which are oxidized at temperatures lower than the temperature to be used in the case of heat-treating the printing sheet to thereby change into such oxide type white ceramics. Especially preferably used among these from the standpoints of whiteness, sinter strength, etc., are acicular crystals such as those of potassium titanate or aluminum borate.

Other examples of the inorganic particles include red particles such as manganese oxide-alumina, chromium oxide-tin oxide, iron oxide or cadmium sulfide-selenium sulfide, blue particles such as cobalt oxide, zirconia-vanadium oxide or chromium oxide-divanadium pentoxide, black particles such as chromium oxide-cobalt oxide-iron oxide-manganese oxide, chromates or permanganates, yellow particles such as zirconium-silicon-praseodymium, vanadium-tin or chromium-titanium-antimony, green particles such as chromium oxide, cobalt-chromium or alumina-chromium, and pink particles such as aluminum-manganese or iron-silicon-zirconium.

On the other hand, use of a silicone rubber is effective in improving flexibility and resistance to hot nitric acid. One or more suitable silicone rubbers can be used for these purposes without particular limitations. Various modified silicone rubbers are also usable, such as phenol-modified, melamine-modified, epoxy-modified, polyester-modified, acrylic-modified, and urethane-modified silicone rubbers. A preferred silicone rubber is one excellent in shape retention and flexibility.

In the case where the printing sheet containing the MQ resin is burned at a temperature of about 400° C. or higher in obtaining a burned sheet, the MQ resin is deprived of its organic groups, such as silicon-bonded methyl groups, and thus changes into fine silica particles, which undergo sintering. In this heat treatment, it is effective to use a melting point depressant for silica which serves to lower the melting point of the silica and thereby enhance the sinter strength. If a melting point depressant is not incorporated, the resulting sintered sheet is insufficient in strength and has a surface hardness in terms of pencil hardness of about 4H, indicating that the surface thereof is readily broken by mechanical impacts. Namely, the ink information on this sintered sheet is apt to be burned out. In contrast, by incorporating KOH (melting point depressant) into a printing sheet in an amount of 4,000 ppm, the surface hardness of the sheet can be increased to 9H or higher, which corresponds to that of ceramic labels.

The melting point depressant that can be used is one or more appropriate substances capable of lowering the melting point of silica. Examples thereof include alkali metals such as potassium, sodium, and lithium. Although such an alkali metal can be incorporated in the form of a powder thereof or the like, it is preferred in the invention that the melting point depressant be dispersed as uniformly as possible throughout the ink-receiving layer. From this standpoint, finer particles are advantageous. It is therefore possible to incorporate an alkali metal as a compound thereof which is easily available as fine particles. The kind of this alkali metal compound is not particularly limited and an appropriate one may be used, such as hydroxide or carbonate.

In the coating liquid, the amount of the cellulosic polymer is preferably 300 parts by weight or smaller, more preferably from 5 to 200 parts by weight, most preferably from 10 to 100 parts by weight, per 100 parts by weight of the silicone resin from the standpoints of ink fixability, etc. The inorganic particles as an optional ingredient may be used in an amount of preferably from 10 to 500 parts by weight, more preferably from 20 to 350 parts by weight, most preferably from 30 to 100 parts by weight, per 100 parts by weight of the silicone resin from the standpoints of the handleability and strength of the printing sheet, the strength and hiding power of the burned sheet, etc.

The silicone rubber as an optional ingredient may be used in an amount of preferably from 1 to 1,000 parts by weight, more preferably from 5 to 500 parts by weight, most preferably from 10 to 200 parts by weight, per 100 parts by weight of the silicone resin from the standpoints of improving chemical resistance, etc. In the case of using a silicone rubber in combination with the silicone resin, the above-described ranges of the amount of inorganic particles to be used are preferably based on the total amount of the silicone resin and the silicone rubber from the standpoints of the handleability and strength of the printing sheet, the strength and hiding power of the burned sheet, etc.

On the other hand, the melting point depressant for silica as an optional ingredient can accomplish the purpose of the incorporation thereof when incorporated even in an amount as small as at least 0.01 ppm of the ink-receiving layer as determined by the water extraction method. The amount of the melting point depressant to be used can hence be suitably determined according to the desired strength of the burned sheet to be obtained, etc. The strength of the burned sheet is influenced also by the diameter of the fine silica particles formed from the silicone resin. The particle diameter thereof is theoretically thought to be about 1 nm. As long as such fine particles are contained even in an amount as small as below 1% by weight based on the ink-receiving layer, a burned sheet can be obtained as a strong sinter even when burning is conducted at a temperature of 500° C. or lower. Consequently, from the standpoints of the strength of the burned sheet to be obtained and the formability of the printing sheet, etc., in view of the diameter of the fine silica particles and the attainment of a reduction in burning temperature, the melting point depressant for silica is incorporated in an amount of preferably at least 0.1 ppm, more preferably from 50 to 10,000 ppm, most preferably from 100 to 5,000 ppm, per 100 parts by weight of the silicone resin.

The organic solvent optionally used in preparing the coating liquid may be one or more appropriate solvents. The organic solvent generally used is toluene, xylene, butyl carbitol, ethyl acetate, butyl Cellosolve acetate, methyl ethyl ketone, methyl isobutyl ketone, or the like. Although the coating liquid is not particularly limited, it is preferably prepared so as to have a solid concentration of from 5 to 85% by weight from the standpoints of spreadability, etc. In preparing the coating liquid, appropriate additives can be incorporated according to need, such as a dispersant, plasticizer, and combustion aid. A defoamer may be incorporated into the coating liquid to accelerate the defoaming of a spread layer.

Although the thickness of the ink-receiving layer to be formed may be suitably determined according to the intended use of the printing sheet, etc., it is generally from 5 μm to 5 mm, preferably from 10 μm to 1 mm, more preferably from 20 to 200 μm. The printing sheet produced by the invention is not particularly limited as long as it comprises the ink-receiving layer in sheet form and a side of the ink-receiving layer which was in contact with the poly(vinylidene fluoride) side of the carrier film is peeled therefrom and is exposed to constitute an ink-receiving surface. The printing sheet can therefore have an appropriate constitution. Examples thereof include a constitution consisting of an ink-receiving layer alone, a constitution comprising an ink-receiving layer reinforced with a reinforcing substrate, and a constitution having a pressure-sensitive adhesive layer.

The reinforced constitution may be formed by an appropriate method such as a method in which an ink-receiving layer is disposed on a reinforcing substrate or a method in which an ink-receiving layer containing a reinforcing substrate disposed therein is formed. The reinforcing substrate may be an appropriate one such as a resin coating layer, resin film, fibers, fabric, non-woven fabric, metal foil, or net. The reinforcing substrate may be made of a material which disappears upon heating, such as a polymer, e.g., a polyester, polyimide, fluororesin, or polyamide, or may be made of a material which does not disappear upon heating, such as a glass, ceramic, or metal.

The printing sheet can be made porous for the purpose of enabling decomposition gases resulting from heating to volatilize smoothly or for other purposes. There are cases where printed sheets swell due to decomposition gases resulting from heating especially when the printing sheets have a pressure-sensitive adhesive layer for provisional bonding. This swelling can be avoided by forming a porous printing sheet. For forming a porous printing sheet, an appropriate method can be used, such as a method in which many fine holes are formed in a printing sheet by punching or the like or a method in which a woven fabric, a non-woven fabric, a metal foil having many fine holes, a net, or the like is used as a reinforcing substrate.

The printing sheet produced by the invention is preferably used in applications in which it is bonded to an adherend either as it is or as a printed sheet obtained by imparting information thereto. Especially preferred among such applications is one in which the printing sheet or printed sheet is provisionally bonded to an adherend and is then heated to thereby tightly bond the sheet to the adherend. A method may be used for this heat treatment, in which an adherend is placed on the printing sheet and then heated to thereby tightly bond the sheet of the adherent.

There are cases where the printing sheet or printed sheet according to the invention can adhere to an adherend by means of its own pressure-sensitive adhesive properties. However, a pressure-sensitive adhesive layer may be formed on the sheet for the purpose of improving the bonding strength thereof or for other purposes. The pressure-sensitive adhesive layer can be formed in an appropriate stage before the printing sheet or printed sheet is bonded to an adherend. Namely, it maybe formed before information is imparted to the printing sheet to obtain a printed sheet, or may be formed after a printed sheet has been thus obtained.

For forming a pressure-sensitive adhesive layer, an appropriate pressure-sensitive adhesive material can be used, such as a pressure-sensitive adhesive based on a rubber, acrylic, silicone, or vinyl alkyl ether. An appropriate method can be used for forming the pressure-sensitive adhesive layer. Examples thereof include a method in which a pressure-sensitive adhesive material is applied to the printing sheet or printed sheet by an appropriate coating technique using, e.g., a doctor blade or gravure roll coater and a method in which a pressure-sensitive adhesive layer is formed on a separator by such a coating technique and the adhesive layer is transferred to the printing sheet or printed sheet. It is also possible to form a pressure-sensitive adhesive layer made up of dots of a pressure-sensitive adhesive, for the purpose of enabling decomposition gases resulting from the optional heat treatment to volatilize smoothly or for other purposes. In this case, a more preferred constitution is one in which the printing sheet is porous as described above. Such a pressure-sensitive adhesive layer made up of pressure-sensitive adhesive dots or the like can be formed by a coating technique such as the rotary screen process.

Although the thickness of the pressure-sensitive adhesive layer to be formed can be determined according to the intended use thereof, etc., it is generally from 1 to 500 μm, preferably from 5 to 200 μm. It is preferred to cover the thus-formed pressure-sensitive adhesive layer with a separator or the like in order to prevent fouling, etc., until the adhesive layer is bonded to an adherend. For bonding the printing sheet or printed sheet to an adherend, a method in which the sheet is automatically applied by a robot or the like can be used.

A printed sheet can be obtained by an appropriate method such as a method in which ink information or engraved information comprising either holes or projections and recesses is imparted to the printing sheet or a method in which an appropriate shape is punched out of the printing sheet. It is also possible to form a printed sheet having a combination of the above-described information elements or having a combination of different kinds of information formed by any of other various methods. The ink information can be imparted by handwriting or by an appropriate printing technique such as coating through a patterned mask, transfer of a pattern formed on a transfer paper, or printing with a printer. Preferred of these is printing with a printer, in particular, a thermal transfer printer, because this printing technique is advantageous in, for example, that any desired ink information can be efficiently imparted highly precisely according to circumstances.

An appropriate ink can be used, such as an ink containing a colorant such as a pigment, in particular, a heat-resistant colorant such as an inorganic pigment. The ink may contain a glass frit or the like so as to have improved fixability after heat treatment or for other purposes. An ink sheet such as a printing ribbon for use in thermal transfer printers can be obtained by, for example, adding a binder such as a wax or polymer to such an ink and causing a supporting substrate comprising a film, a fabric, or the like to hold the resulting ink composition. Consequently, a known ink or an ink sheet containing the same can be used in thermal transfer printing or the like.

The ink information to be imparted is not particularly limited, and appropriate ink information may be imparted, such as characters, a design pattern, or a bar code pattern. In the case where an identification label, e.g., a management label, is formed or in similar cases, it is preferred to impart ink information so that a satisfactory contrast or a satisfactory difference in color tone is formed between the printing sheet and the ink information after the optional heat treatment. The step of imparting ink information or a shape to the printing sheet may be conducted either before or after the printing sheet is bonded to an adherend. In the case where a printer is used for imparting ink information, the generally employed method is to prepare beforehand a printed sheet having ink information and bond the same to an adherend.

The heat treatment of the printing sheet or printed sheet which has been bonded to an adherend can optionally be conducted under suitable conditions according to the heat resistance of the adherend, etc. The heating temperature is generally 1,200° C. or lower, preferably from 200 to 650° C., more preferably from 350 to 550° C. During the heat treatment, the organic components including those contained in the pressure-sensitive adhesive layer disappear and the silicone resin and the like contained in the printing sheet cure while uniting with the ink information. As a result, a burned sheet tightly bonded to the adherend is formed.

The printing sheet or printed sheet according to the invention can be advantageously used in various applications such as the printing or coloring of various articles including pottery, glassware, ceramics, metallic products, and enameled products and the impartation of identification information or identification marks comprising bar codes to such articles. In particular, in the case of forming a burned sheet through a heat treatment, the printing or printed sheet can be advantageously used in forming management labels or the like which are utilizable, e.g., from the production of Braun tubes to the reclamation of reworkable parts from recycled Braun tubes, because the burned sheet obtained from the printing or printed sheet has such excellent chemical resistance that it withstands immersion in hot nitric acid and satisfactorily retains the ink information. The adherend may have any shape such as a flat shape or a curved shape as of containers.

EXAMPLE 1

130 Parts by weight (hereinafter all parts are by weight) of an MQ resin (manufactured by Shin-Etsu Chemical Co., Ltd.), 60 parts of ethyl cellulose, 80 parts of potassium titanate, 30 parts of a silicone rubber (manufactured by Shin-Etsu Chemical Co., Ltd.), and 0.4 parts of potassium hydroxide were uniformly mixed with toluene. The resulting dispersion was applied on a poly(vinylidene fluoride) film having a thickness of 50 μm with a doctor blade. The coating was dried to form an ink-receiving layer having a thickness of 65 μm.

On the other hand, a toluene solution containing 100 parts of poly(butyl acrylate) having a weight average molecular weight of about 1,000,000 was applied with a doctor blade on a separator which was a 70 μm-thick glassine paper coated with a silicone release agent. The solution applied was dried to form a pressure-sensitive adhesive layer having a thickness of 20 μm. This adhesive layer supported on the separator was applied to the exposed side of the ink-receiving layer, and the poly(vinylidene fluoride) film was peeled from the ink-receiving layer to obtain a printing sheet.

Subsequently, ink information comprising a bar code was imparted to the ink-receiving layer (on the side exposed by the peeling) of the printing sheet using a thermal transfer printer and a commercial ink ribbon holding a wax-based ink containing a black metal oxide pigment and a bismuth glass. Thus, a printed sheet was obtained.

COMPARATIVE EXAMPLE 1

An ink-receiving layer, printing sheet, and printed sheet were obtained in the same manner as in Example 1, except that a PET film was used in place of the poly(vinylidene fluoride) film.

COMPARATIVE EXAMPLE 2

An ink-receiving layer, printing sheet, and printed sheet were obtained in the same manner as in Example 1, except that a polyethylene film was used in place of the poly (vinylidene fluoride) film.

COMPARATIVE EXAMPLE 3

An ink-receiving layer, printing sheet, and printed sheet were obtained in the same manner as in Example 1, except that a PET film having a coating film of a silicone release agent formed on a surface thereof was used in place of the poly(vinylidene fluoride) film.

EVALUATION TEST

In each of the Example and Comparative Examples, the carrier film was peeled from the ink-receiving layer at ordinary temperature to examine the strippability thereof. Furthermore, the state of the ink information imparted to each printed sheet was examined. The results obtained are shown in the following table.

TABLE

| | Example 1 | Comparative Example 1 | Comparative Example 2 | Comparative Example 3 |
|---|---|---|---|---|
| Strippability | Good | Poor*[1] | Good | Good |
| Ink information | Clear | Clear | Blurred | Blurred |

*[1]: Strippable in an atmosphere of −30° C. or lower.

What is claimed is:

1. A process for producing a printing sheet which comprises spreading a coating liquid containing at least a cellulosic polymer and a silicone resin as components on a carrier film wherein at least a surface layer on the side to be coated with the coating liquid comprises poly(vinylidene fluoride), and drying the coating to form an ink-receiving layer.

2. The process for producing a printing sheet of claim 1, wherein the coating liquid further contains at least either of inorganic particles or a silicon rubber.

* * * * *